United States Patent [19]

Högner

[11] 4,411,028

[45] Oct. 25, 1983

[54] DEVICE FOR ACTUATING A POPPET OF A TUB DRAIN VALVE

[75] Inventor: Johannes Högner, Schiltach, Fed. Rep. of Germany

[73] Assignee: Firma Hans Grohe GmbH & Co. KG, Fed. Rep. of Germany

[21] Appl. No.: 357,717

[22] Filed: Mar. 12, 1982

[30] Foreign Application Priority Data

Mar. 16, 1981 [DE] Fed. Rep. of Germany ..... 3110151

[51] Int. Cl.[3] ..... E03C 1/24

[52] U.S. Cl. ..... 4/199; 4/204

[58] Field of Search ..... 4/191, 199, 194, 201, 4/203, 204, 205, 295, 286, 287

[56] References Cited

U.S. PATENT DOCUMENTS

| | | | |
|---|---|---|---|
| 1,980,493 | 11/1934 | Morisseau | 4/199 |
| 2,059,120 | 10/1936 | Kreuzar et al. | 4/199 |
| 2,844,168 | 7/1958 | Klingler | 4/199 X |
| 3,315,279 | 4/1967 | Nolan | 4/204 X |

*Primary Examiner*—Henry K. Artis

*Attorney, Agent, or Firm*—McGlew and Tuttle

[57] ABSTRACT

An apparatus for operating a poppet valve which is mounted in a tub drain for upward and downward movement in a vertical drain pipe which also has a laterally extending horizontal tubular drain pipe portion comprises a guide tube which extends radially of the poppet valve and carries a control slide which is slidable therein under the control of a remote control which is connected thereto by a cable. A bearing cylinder extends into the horizontal tubular drain portion and it carries a rotatably journal pin of a lever assembly which is connected between the control slide and the poppet valve. The lever assembly includes in addition to the journal pin portion which is rotatable in the bearing cylinder, a first lever arm portion which has an end connected to the rotatable pin on the exterior of the bearing cylinder and an opposite end of the first lever arm which is connected to the control slide so that movement of the control slide causes movement of this lever arm portion and rotation of the journal pin in the bearing cylinder. The lever assembly includes a second lever arm portion which extends radially into the horizontal tub drain portion and is bent at its outer end so as to extend axially of the horizontal drain portion and radially of the vertical portion to position to position its outer end at a location below and in contact with the poppet valve. Displacement of the slide causes the selected upward or downward movement of this outer end and the opening and closing poppet valve. A feature of the construction is that the operating control mechanism may be assembled into the horizontal portion and vertical portion of the drain valve and merely inserting the second lever arm portion through an opening of the bearing cylinder to position this lever arm portion relative to the poppet to simultaneously connect the outer first lever arm portion to the slide.

9 Claims, 4 Drawing Figures

DEVICE FOR ACTUATING A POPPET OF A TUB DRAIN VALVE

FIELD AND BACKGROUND OF THE INVENTION

This invention relates in general to drain valves and particularly to a new and useful apparatus for operating a poppet valve of a tub drain.

In a prior art device of this kind (German OS No. 25 49 723), the lever for actuating the poppet is designed as a straight bar which is radially screwed into a taphole of the journal pin. The taphole is located about at the center of the longitudinal axial extension of the journal pin, so that one half of the journal pin and of the bearing sleeve extends to one side of the mid plane perpendicular to the journal pin axis of the poppet or the valve housing, while the other half of the bearing sleeve and the journal extends to the other side of this plane. Therefore, the actuating lever by which the poppet is loosely supported cannot be screwed into the journal pin before the journal pin is inserted into the bearing sleeve. Then, the actuating lever must be introduced to the taphole of the journal pin either through the lower front opening of the valve housing or through the horizontal tubular connection which is provided at the valve housing side diametrally opposite to the bearing sleeve. This is time consuming and expensive. Further, the screwed connection between the actuating lever and the journal pin may later become loose. The journal pin is provided with an eccentric which is linked through a screw to a slide which is displaceable transversely to the journal pin axis and connected to the Bowden cable. This connection between the eccentric and the slide again can be effected only after inserting the journal pin into the bearing sleeve.

SUMMARY OF THE INVENTION

The invention is directed to a tub drain valve which can be manufactured at lower costs and mounted or dismounted in a simpler way, particularly also for maintenance purposes.

In accordance with the invention, an apparatus for operating a poppet valve which is mounted in a tub drain for upward and downward movement in a vertical drain pipe portion which also has a laterally extending horizontal tubular drain portion comprises a guide tube which extends radially of the poppet valve having a control slide slidable in the guide tube for operating the poppet valve. A control slide is connected to its outer end through a so-called Bowden cable which may be operated remotely to cause displacement of the slide and control of the poppet valve. The construction includes a bearing cylinder which extends into the horizontal tubular drain portion. The lever assembly includes a journal pin which is journaled in the bearing cylinder, a first lever arm portion which is connected on the exterior of the bearing cylinder to the slide and a second lever arm portion which extends through the bearing cylinder and into the horizontal portion and radially to the vertical portion beneath the poppet valve. Movement of the slide causes rotation of the journal pin and movement of the second arm portion which is located beneath the poppet valve to either raise or lower it in accordance with the direction of the slide movement.

Due to this design, the actuating lever firmly secured to the journal pin can be introduced from the outside through the bearing hole into its operating position within the valve housing and, if needed, removed again in the same way. The second lever arm portion is bent from its radially extending position which connects to the journal pin in a radial curve which causes it to extend substantially axially of the horizontal portion and radially into the vertical portion. The bend of the lever arm portion is effected at a location spaced from the inside of the front face of the journal pin by a distance which is at least approximately corresponds to the spacing of the outer face of the bearing cylinder from the inside face of the interior of the horizontal tubular drain portion. It is advisable to have the axial length of the bearing cylinder bore approximately equal to the inside diameter of the bore. The radius of the bend advantageously corresponds to about half the inside diameter of the tubular horizontal portion of the drain pipe. The actuating lever portion advantageously bends through an opening in the horizontal portion of the drain directly into the bearing cylinder defined on the outside of this horizontal portion which accommodates the journal pin. Thus, the horizontal portion of the drain pipe is advantageously formed with the radially extending cylindrical bearing sleeve to accommodate the journal pin. The pin has a dimension such that it abuts against the interior sleeve shoulder which permits the lever portion of the operating mechanism to enter through the opening of the bore through the wall of the horizontal pipe portion.

Accordingly, it is an object of the invention to provide an improved operating mechanism for operating a poppet valve in a tub drain which may be easily installed or removed and which may be operated through a remote control connection.

A further object of the invention is to provide an operating mechanism for a drain valve which is simple, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
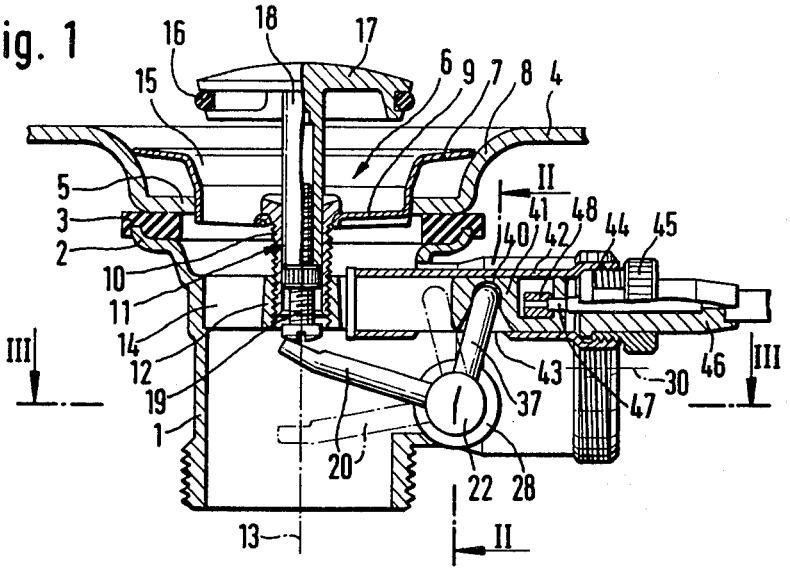
FIG. 1 is an elevational view, partly in section of a completely mounted drain valve constructed in accordance with the invention.

Referring to the drawings, in particular the invention embodied therein comprises an apparatus for operating a poppet valve 17 which is mounted in a tub drain for upward and downward movement in a vertical drain pipe portion or housing 1 which also includes a laterally extending horizontal tubular drain pipe portion 29. The operating mechanism includes a guide tube 42 which extends radially of the poppet valve 17 and has a control slide 41 slidable therein which has a remote end which is remote from the poppet valve which is adapted to be connected to a remote control which in the example illustrated comprises a Bowden cable 46 which is connected outwardly for operation at a remote control location to shift the slide either inwardly or outwardly. The operating mechanism also includes a bearing cylinder 28 which extends into the horizontal tubular drain portion 29. A lever assembly is connected between the control slide 41 and the poppet valve 17 and includes a journal pin portion 22 which is rotatably mounted in the bearing cylinder 28. It also includes a first lever arm portion 37 which has one end connected to the pin portion 22 in location exteriorally of the bearing cylinder 28. It also includes an opposite end which is connected to the control slide and is movable with the control slide to rotate journal pin 22. The lever assembly also includes a second lever arm portion 28 which extends radially into the horizontal tube drain portion and bent at its outer end so as to extend axially of the horizontal drain portion and radially of the vertical portion so that its outer end terminates at a location below and in contact with the poppet valve. Displacement of the slide 41 by the remote control mechanism therefore causes movement of the arm 37 and rotation of the bearing pin 22 and shifting of the outer end of the lever arm portion 20 selectively upwardly and downwardly so as to either open or close the poppet valve.

The shown valve substantially comprises a tubular valve housing 1 having an upper supporting flange 2 by which it is secured, in a manner known per se, to the underside of a tub bottom 4, with the interposition of a gasket 3. In the mounting hole 5 at a depressed location of the tub bottom 4, a valve seat body 6 is provided whose flange 7 sealingly applies against the flank 8 of the tub bottom depression. Valve seat body 6 has an apertured bottom 9 and is connected through a centrally disposed hub 11 having an external thread 10, to a threaded hub 12 of valve housing 1. Threaded hub 12 extends coaxially with the valve housing (axis 13) and is connected to the substantially cylindrical wall thereof through spokes 14. On its inside, valve seat body 6 has a seat 15 for the sealing ring 16 of a poppet 17. Poppet 17 is guided for free axial motion by a centric stem 18. Stem 18 is coaxially downwardly extended by a set screw 19 whose head is loosely supported on an actuating lever 20. Actuating lever 20 is bent to at least one quarter of a circle and extends from the inside front face 21 of a journal pin 22 to the axis 13 of the valve housing or the poppet. Journal pin 22 is mounted for rotation in a bearing hole 24 and carries two O-rings 26 which are received in two circular grooves 25.

Figure 2:
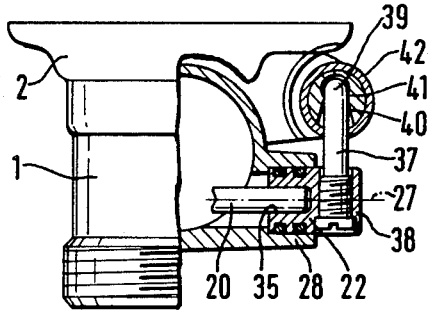
FIG. 2 is a partial elevational and partial sectional view taken along the line II—II of FIG. 1.

Since the drain valve will be mounted in the position shown in FIG. 1, the axis 13 of the valve housing extends vertically. For the same reason, the axis 27 of journal pin 24 extends horizontally (FIG. 2). Bearing hole 24 is provided in a short cylindrical sleeve 28 which projects from, and is formed integrally with, a tubular connection 29 usually provided in such drain valves. This tubular connection 29 serves the purpose of connecting to an overflow pipe and it is mounted in horizontal position, with its axis 30 extending radially to the valve housing axis 13.

Bearing hole 24 extends from the outer front face of sleeve 28 to an inside radial shoulder 32 (FIG. 4), and is followed by a hole 33 of smaller diameter extending through the wall of tubular connection 29. In the shown example, radial shoulder 32 serves as an axial stop for journal pin 22. The diameter of journal pin 22 is about twice the thickness of actuating lever 20. As shown in FIGS. 1 and 2, sleeve 28 with bearing hole 24 is provided in the zone of the lower portion of tubular connection 29 and its axis 27 extends at a level approximately intermediate between the lower, closing position and the upper, open position (shown in FIG. 1) of set screw 19 of poppet 17. The lower or closing position of set screw 19 follows from the lower pivotal position of actuating lever 20 indicated in FIG. 1 in dash-dotted lines.

Only a portion of journal pin 22 is received in bearing hole 24. The axial distance b between the outer front face 31 of sleeve 28 and the inside surface of tubular connection 29 is smaller than half the inside diameter D of tubular connection 29. The bend of actuating lever 20 begins at a location on the lever portion secured to journal pin 22, which is spaced from the inside front face 21 of the journal pin by a distance a corresponding at least approximately to the actual spacing b between the outer front face 31 of sleeve 28 and the inside surface of tubular connection 29. The bend of actuating lever 20 has a radius R which is about one half the inside diameter D of tubular connection 29. The respective end portion of actuating lever 20 is soldered in a central blind hole 35 of journal pin 22 and thus non-rotatably fixed thereto. Actuating lever 20 might also be made in one piece with journal pin 22, or screwed thereto.

Figure 3:
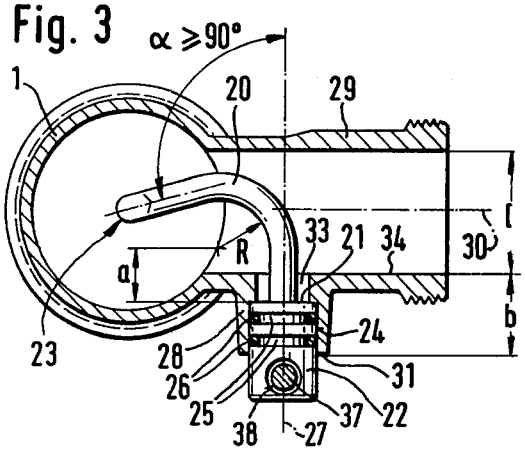
FIG. 3 is a sectional view taken along the line III—III of FIG. 1.
Figure 4:
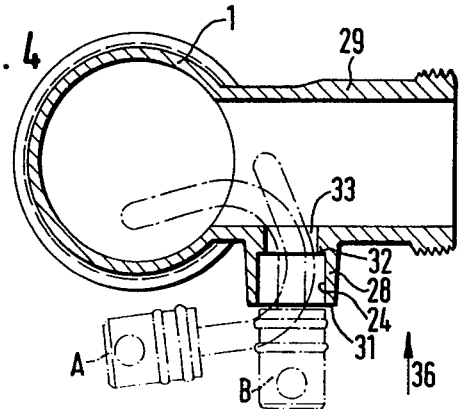
FIG. 4 is a view similar to FIG. 3 indicating the manner of introducing the actuating lever.

The actuating lever 20 firmly fixed to journal pin 22 can thus be introduced from the outside through hole 33 into valve housing 1, into its operating position. The successive positions during this introduction are indicated in FIG. 4 as positions A and B. Then, from position B, journal pin 22 is axially shifted in the direction of arrow 36 into bearing hole 24, so that actuating lever 20 comes into the position shown in FIG. 3. To remove the actuating lever from valve housing 1, the motions are performed in reverse order.

To make possible a remote control, i.e., pivoting of actuating lever 20 by turning journal pin 22 between an upper and lower position, the journal pin portion projecting from bearing hole 24 is provided with a rod-shaped arm 37. This arm 37 is screwed in a tapped, crosswise extending thruhole and projects by its free rounded end 39 into a partly conical and partly dome-shaped recess 40 of a slide 41. Slide 41 is mounted for axial displacement in a guide tube 42 which extends parallel and adjacent tubular connection 29, thus transversely to bearing hole 24, and at a vertical distance above the portion projecting from bearing hole 24 of journal pin 22. On its underside, guide tube 42 is provided with an axially extending slot 43 through which arm 37 projects into recess 40 of slide 41. On one of its ends, guide tube 42 is enlarged to an internally threaded socket 44 into which the tail piece 46 of a Bowden cable is secured by a threaded bushing 45. The cable 47 is positively locked to slide 41 by means of a nipple 48. Through this Bowden cable, slide 41 is connected to a turning mechanism (not shown) which is preferably comprised in the overflow device of the tub and by which slide 41 can be moved in the longitudinal direction of guide tube 42. This axial motion of slide 41 is transformed by arm 37 into a rotary motion of journal pin 22 and pivotal motion of actuating lever 20 through which poppet 17 is lifted or lowered.

Since arm 37 is guided both in slot 43 of guide 42 and in recess 40 of slide 41, journal pin 22 is secured against axial displacement in bearing hole 24 in both directions. Therefore, it is not absolutely necessary to provide a radial shoulder 32 in sleeve 28, bearing hole 24 may rather be designed as a thruhole of constant diameter, and no particular measures need by provided for securing journal pin 22 against axial displacement. During the mounting operation, arm 37 may be screwed into crosswise taphole 38 from below, after inserting journal pin 22 into bearing hole 24, and for dismounting, arm 37 may be unscrewed first.

While specific embodiments of the invention have been shown and described in detail to illustrate the application of the principles of the invention, it will be understood that the invention may be embodied otherwise without departing from such principles.

What is claimed is:

1. An apparatus for operating a poppet valve which is mounted in a tub drain for upward and downward movement in a vertical drainpipe portion which also has a laterally extending horizontal tubular drain pipe portion, comprising a guide tube extending radially of the poppet valve, a control slide slidable in said guide tube and gaving a remote end remote from the poppet valve adapted to be connected to a remote control, a bearing cylinder extending into the horizontal tubular drain portion, a lever assembly connected between said control slide and said poppet valve including a journal pin portion rotatably mounted in said bearing cylinder, a first lever arm portion having one end connected to said pin portion and an opposite end connected to said control slide, and a second lever arm portion extending radially into the horizontal tub drain portion and being bent at its outer end so that it extends axially of the horizontal drain portion and radially of the vertical portion to a position at its outer end at a location below and in contact with the poppet valve, displacement of said slide causing movement of said first lever arm portion, rotation of said journal pin portion and shifting of the outer end of said second lever arm portion selectively upwardly or downwardly.

2. An apparatus according to claim 1, including a turning knob mounted on said guide tube being coupled to said slide and having a Bowden cable connection for a remot control operation.

3. An apparatus according to claim 1, including means for interengaging and inter locking a first lever arm portion with said slide, said first lever arm portion extending exteriorally of said bearing cylinder, said bearing cylinder extending eccentrically of and perpendicularly to the axis of said vertical portion of the drain and to the axis of said guide tube.

4. An apparatus according to claim 1, wherein the bend of said actuating lever second arm portion begins at a location which is spaced from the inside front face of said journal pin by a distance at least approximately equal to the spacing of the outside front face of said bearing sleeve, the inside surface of said horizontal portion of the drain pipe.

5. An apparatus according to claim 4, wherein said second lever arm portion is bent at a radius corresponding to about half the inside diameter of the horizontal portion of said drain pipe.

6. An apparatus according to claim 4, wherein said bearing cylinder joins into the horizontal portion and has an outer bore portion with a shoulder, said journal pin having a front face adjacent said shoulder.

7. An apparatus according to claim 6, wherein said bearing cylinder has an opening interiorally of the shoulder extending into the horizontal tubular portion.

8. An apparatus according to claim 7, wherein said bearing cylinder has an opening into the horizontal portion which is of less diameter than the remaining portion of said cylinder so as to define said shoulder betwerebetween.

9. An apparatus according to claim 1, wherein said bearing cylinder extends horizontally, said guide tube extending horizontally in a substantially right angle to said bearing cylinder and located above said bearing cylinder, said first lever arm portion of said lever assembly extending radially from said journal pin, said guide tube and said slide having slidable openings facing said bearing cylinder, said first lever arm portion including a bent off portion engageable into the opening of said guide tube and said control slide, the outer end of said first lever arm portion and said opening of said slide being rounded to provide for rolling interengagement thereof.

* * * * *